US008238773B2

(12) United States Patent
Usami et al.

(10) Patent No.: US 8,238,773 B2
(45) Date of Patent: Aug. 7, 2012

(54) IMAGE FORMING APPARATUS AND CONTROL METHOD THEREFOR WHICH CONTROLS A PRIMARY AND SECONDARY TRANSFER ELECTRIC FIELD

(75) Inventors: Motohiro Usami, Sagamihara (JP); Shinji Aoki, Yokohama (JP); Fumihito Masubuchi, Ebina (JP)

(73) Assignee: Ricoh Company, Limited, Tokyo (JP)

( * ) Notice: Subject to any disclaimer, the term of this patent is extended or adjusted under 35 U.S.C. 154(b) by 261 days.

(21) Appl. No.: 12/723,050

(22) Filed: Mar. 12, 2010

(65) Prior Publication Data

US 2010/0232820 A1 Sep. 16, 2010

(30) Foreign Application Priority Data

Mar. 13, 2009 (JP) ..... 2009-060809

(51) Int. Cl.
*G03G 15/16* (2006.01)

(52) U.S. Cl. ..... 399/66; 399/302; 399/308

(58) Field of Classification Search ..... 399/66, 399/302, 308
See application file for complete search history.

(56) References Cited

U.S. PATENT DOCUMENTS 5,546,172 A * 8/1996 Seto
2004/0213598 A1* 10/2004 Mori et al.
2005/0244179 A1* 11/2005 Rakov et al. ..... 399/66
2007/0008395 A1 1/2007 Masubuchi et al.
2008/0101811 A1* 5/2008 Mochizuki ..... 399/66
2009/0123168 A1 5/2009 Aoki et al.
2009/0136270 A1* 5/2009 Yamada ..... 399/308

FOREIGN PATENT DOCUMENTS

JP 6-289682 10/1994
JP 9-236964 9/1997
JP 2001-100545 4/2001
JP 3340221 8/2002
JP 2007-121619 5/2007
JP 2008026832 A * 2/2008

* cited by examiner

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

An image forming apparatus includes an image carrier, an intermediate transfer member, a primary transfer member, and a power supply unit to form a primary-transfer electric-field between the image carrier and the primary transfer member by performing constant-current control. The primary transfer member also detects a change in a primary transfer voltage in a sub-scanning direction that is applied to the primary transfer member from the power supply unit in the sub-scanning direction. There is a conductive member, a secondary transfer member, and a secondary-transfer electric-field forming member to apply a secondary transfer current to the secondary transfer member or the conductive member. A control device controls the secondary transfer current applied to the secondary transfer member or the conductive member in accordance with the change in the primary transfer voltage in the sub-scanning direction detected by the power supply unit.

15 Claims, 6 Drawing Sheets

IMAGE FORMING APPARATUS AND CONTROL METHOD THEREFOR WHICH CONTROLS A PRIMARY AND SECONDARY TRANSFER ELECTRIC FIELD

CROSS-REFERENCE TO RELATED APPLICATIONS

This patent specification claims priority from Japanese Patent Application No. 2009-060809, filed in the Japan Patent Office on Mar. 13, 2009, the entire contents of which are hereby incorporated by reference herein.

BACKGROUND OF THE INVENTION

1. Field of the Invention

The present invention relates to an image forming apparatus such as a copier, a printer, and a facsimile machine, and more particularly, to an electrophotographic image forming apparatus, and a control method therefor.

2. Discussion of the Background

In general, intermediate transfer-type image forming apparatuses primarily transfer toner images developed on image carriers (e.g., photoreceptors) onto an intermediate transfer member (e.g., intermediate transfer belt), ultimately obtaining finished images by secondarily transferring the toner images formed on the intermediate transfer belt onto sheet-like recording media (hereinafter also "sheets").

In certain commonly used image forming apparatuses including multiple photoreceptors, the toner images are sequentially transferred onto the intermediate transfer belt and superimposed one on another thereon, forming a multicolor toner image on the intermediate member. Then, the multicolor toner image on the intermediate transfer member is transferred onto the sheet at once, that is, in a single operation.

In intermediate transfer-type image forming apparatuses, in order to reduce positional deviation and color deviation when operating at high speed, a material such as polyimide resin or polyamide-imide resin is used for the intermediate transfer belt because of its greater elasticity.

However, a drawback of such highly elastic intermediate transfer belts, is that when high-asperity sheets are used it is difficult to attain uniform images because the transfer electric field that is required to transfer the toner from the belt to the sheet is not constant in space but varies. More specifically, gaps are generated between the toner image on the intermediate transfer belt and concave portions of the sheet, thus weakening the transfer electric field compared to convex portions of the sheet. Consequently, it is difficult to reliably transfer the toner image onto the sheet, and white voids become noticeable. This is what is meant herein by the phrase "difficult to attain uniform images".

Moreover, simply increasing a secondary transfer current or a secondary transfer voltage to strengthen the transfer electric field does not solve the problem because discharging occurs in the gap formed in the concave portion, and the polarity of the charge of the toner is reversed by the discharging. Thus, transfer efficiency is degraded, and white void becomes noticeable.

In particular, in image forming apparatuses that keep the secondary transfer current constant, that is, perform constant-current control, the balance among the amount of current flowing due to the movement (transfer) of the toner from the intermediate transfer belt to the sheet, the amount of discharge, and the current flowing directly to a non-image area (i.e., a blank area) of the sheet constantly changes in accordance with printing ratio, the strength of the charge of the toner, and/or the resistivity of the sheet. (Here, the term "printing ratio" refers to the ratio of the image area to the width of the sheet.) Failure to maintain that balance can result in faulty images.

In view of the foregoing, several approaches described below have been tried.

In one known method, for image forming apparatuses, in order to increase adhesion between the toner on the intermediate transfer belt and concave portions of high-asperity sheets, the pressure with which a secondary-transfer bias roller and a secondary-transfer facing roller press against each other is increased.

However, in this case, the pressure is biased toward the toner contacting the concave portion. At this time, non-electrostatic adhesion force among toner particles or between the toner particles and the intermediate transfer belt is increased, with the result that, in some instances, the toner cannot be transferred onto the sheet, in particular, in images consisting of text or thin lines.

In another approach, in order to solve the problem, the intermediate transfer belt is given a laminated two layer-structure, a core layer and an outer layer. The core layer is formed of a material having a higher elasticity and the outer layer is formed of a material having a lower elasticity.

However, in this case, because the respective layers in such a laminated intermediate transfer belt are bonded together with conductive adhesive, it can happen that resistivity is uneven, durability is reduced, and the cost of the intermediate transfer belt is increased.

In order to produce uniform images even on high-asperity sheets regardless of changes in the printing ratio, it is important that the maximum electric field be stably formed within a range that discharging does not occur in the concave portions of the sheets. Namely, it is required that the current applied to the rollers be used almost completely for the movement of the toner from the intermediate transfer belt to the sheet while preventing occurrence of unnecessary discharging.

However, as described above, when the secondary transfer current is kept constant, even when the printing ratio in a main scanning direction in the transfer rollers, that is, the total amount of the charge of the toner to be transferred changes, balance among the amount of current flowing due to movement of the toner from the intermediate transfer belt to the sheet, the amount of discharge, and the amount of current flowing directly to a non-image area of the sheet may be changed. Therefore, with these known approaches described above, consistently applying the current required to transfer the toner for various different images is impossible.

Therefore, in another known method, the secondary transfer current applied to the secondary transfer roller is not kept constant but is changed in accordance with image data. Compared to maintaining a constant secondary transfer current, contrast transfer efficiency can be obtained for various printing ratio of the image.

As another method, controlling the secondary transfer current in accordance with a detected primary transfer voltage has been proposed. In this method, the secondary transfer current is controlled in accordance with the detected primary transfer voltage, in particular the primary transfer voltage as it is affected by humidity and temperature.

However, in this known approach, because changes in the primary transfer voltage in a sub-scanning direction are not detected, the secondary transfer cannot performed in accordance with changes in the printing ratio in a sub-scanning direction caused by fluctuation in the sub-scanning direction.

As described above, in the image forming apparatus, when the secondary transfer current is simply controlled based on the image data, uniform images cannot be produced because of changes in the printing ratio. More specifically, because the amount of the toner adhering to the photoreceptor and the strength of the charge on the toner changes with fluctuations in humidity or temperature, and is affected also by deterioration of the photoreceptor or the developer, the printing ratio from the image data might differ from the printing ratio on the photoreceptor (area ratio of the toner image on the photoreceptor).

Accordingly, there is a need for a technology to attain uniform image transfer in the image forming apparatus even when the intermediate transfer member has great elasticity and the transferred material has large asperity, regardless of changes in the printing ratio.

SUMMARY

In view of the foregoing, one illustrative embodiment of the present invention provides an image forming apparatus that includes an image carrier on which a toner image is formed, an intermediate transfer member onto which the toner image formed on the image carrier is transferred, a primary transfer member, a power supply unit, a conductive member, a secondary transfer member, a secondary-transfer electric-field forming member, and a control device. The primary transfer member, disposed facing the image carrier via the intermediate transfer member, transfers the toner image formed on the image carrier onto the intermediate transfer member. The power supply unit, operatively connected to the primary transfer member, forms a primary-transfer electric-field between the image carrier and the primary transfer member by applying a primary transfer current to the primary transfer member by performing constant-current control and detects a change in a primary transfer voltage in a sub-scanning direction that is applied to the primary transfer member from the power supply in the sub-scanning direction. The conductive member sandwiches a recording medium with the intermediate transfer member. The secondary transfer member, disposed facing the conductive member via the intermediate transfer member, transfers the toner image formed on the intermediate transfer member onto the recording medium. The secondary-transfer electric-field forming member forms a secondary-transfer electric-field between the conductive member and the secondary transfer member and applies a secondary transfer current to the secondary transfer member or the conductive member. The control device, operatively connected to the secondary-transfer electric-field forming member, controls the secondary transfer current applied to the secondary transfer member or the conductive member in accordance with the change in the primary transfer voltage in the sub-scanning direction detected by the power supply unit.

Another illustrative embodiment of the present invention provides a control method for an image forming apparatus including an image carrier, an intermediate transfer member, a primary transfer member, a power supply unit, a secondary transfer member, and a conductive member disposed facing the secondary transfer member via the intermediate transfer member, secondary-transfer electric-field forming member, and a control device. The control method includes forming a primary-transfer electric-field at primary rollers formed between the image carrier and the primary transfer member, applying a constant primary transfer current to the primary transfer member, forming a secondary-transfer electric-field between the conductive member and the secondary transfer member, applying a secondary transfer current to the secondary transfer member and the conductive member, detecting a change in a primary transfer voltage that is applied to primary transfer member in a sub-scanning direction, and controlling the secondary transfer current applied to the secondary transfer member or the conductive member in accordance with the change in the primary transfer voltage in the sub-scanning direction.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
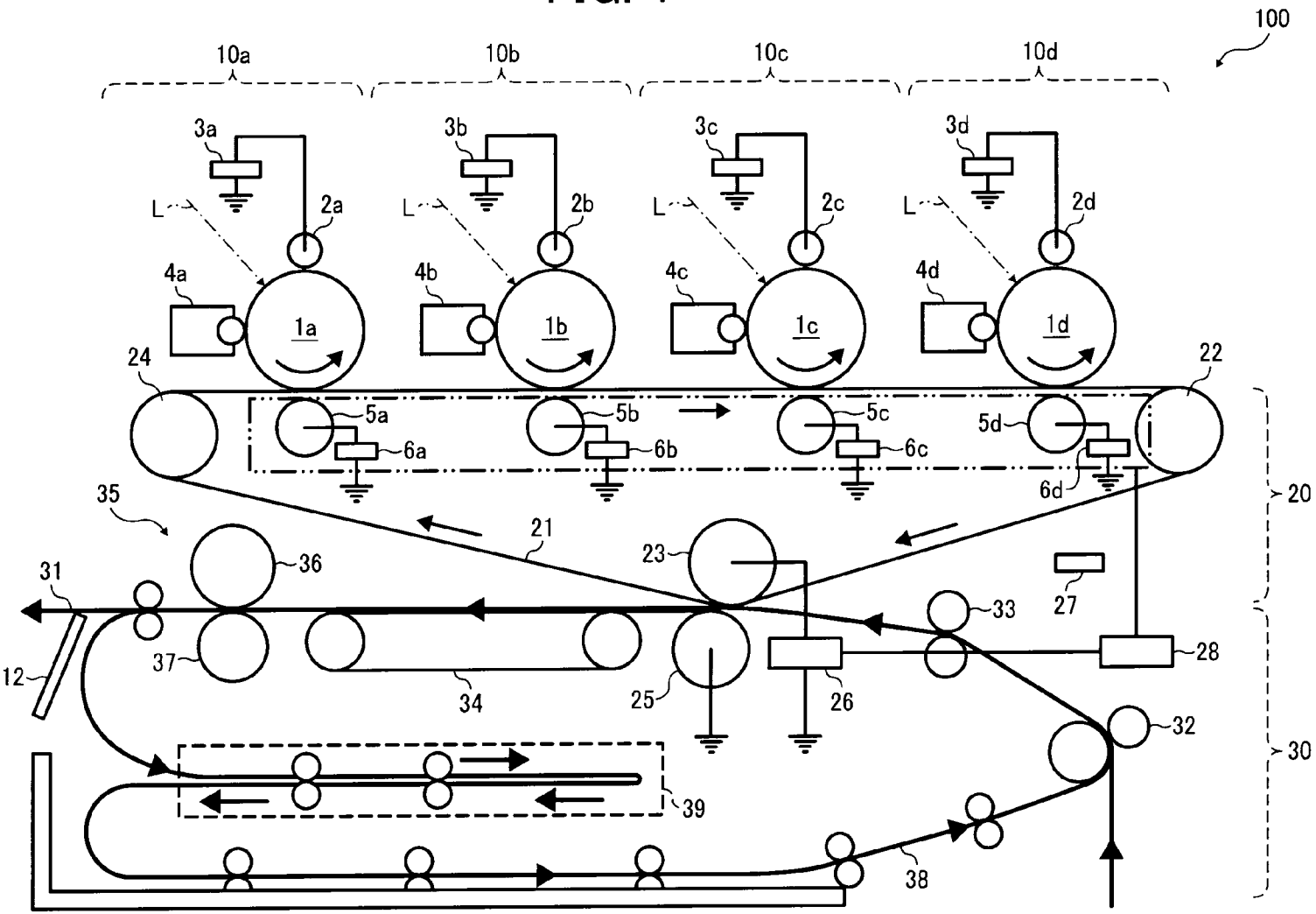
FIG. 1 is an overall schematic view illustrating a configuration of an image forming apparatus according to one illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus that is a tandem-type multicolor printer (hereinafter referred to as a printer) including an intermediate transfer belt according to an illustrative embodiment of the present invention is described. It is to be noted that although the image forming apparatus of the present embodiment is a printer, the image forming apparatus of the present invention is not limited to a printer.

FIG. 1 is a schematic diagram illustrating a configuration of a printer 100.

Referencing FIG. 1, the printer 100 includes four primary-transfer image forming units 10*a*, 10*b*, 10*c*, and 10*d* (referred to collectively as primary-transfer image forming units 10) that form images on drum-shaped photoreceptors 1*a*, 1*b*, 1*c*, and 1*d*, respectively, and primarily transfer the images onto an intermediate transfer belt 21. The drum-shaped photoreceptors 1*a*, 1*b*, 1*c*, and 1*d* serve as image carriers, and the intermediate transfer belt 21 serves as an intermediate transfer member. It is to be noted that the subscripts a, b, c, and d attached to the end of each reference numeral indicate only that components indicated thereby are used for forming different color images, respectively, and hereinafter may be omitted when color discrimination is not necessary.

The primary-transfer image forming unit 10*a*, 10*b*, 10*c*, and 10*d* respectively include noncontact type charging rollers 2*a*, 2*b*, 2*c*, and 2*d* that charge the respective photoreceptors 1, and development devices 4*a*, 4*b*, 4*c* and 4*d* that develop an electrostatic latent image. In each primary-transfer image forming unit 10, both the charging roller 2 and the development device 4 are provided adjacent to the photoreceptor 1.

The printer 100 further includes an exposure device, not shown, that forms latent images by emitting laser light L onto the respective photoreceptors 1 in accordance with image data. The primary-transfer image forming units 10 respectively include primary transfer rollers 5*a*, 5*b*, 5*c*, and 5*d*, and power supplies 6*a*, 6*b*, 6*c*, and 6*d* disposed (referred to collectively as power supplies 6) inside the intermediate transfer belt 21. The four primary transfer rollers 5*a*, 5*b*, 5*c*, and 5*d* are disposed facing the respective photoreceptors 1*a*, 1*b*, 1*c*, and 1*d* via the intermediate transfer belt 21, with the four primary transfer rollers 5*a*, 5*b*, 5*c*, and 5*d* pressing against the photoreceptors 1*a*, 1*b*, 1*c*, and 1*d*, respectively, through the intermediate transfer belt 21. The power supplies 6*a*, 6*b*, 6*c*, and 6*d* are operatively connected to the four primary transfer rollers 5*a*, 5*b*, 5*c*, and 5*d*. Hereinafter, the four primary transfer rollers 5*a*, 5*b*, 5*c*, and 5*d* and the photoreceptors 1*a*, 1*b*, 1*c*, and 1*d* are together also referred to simply as primary rollers.

The primary transfer rollers 5*a*, 5*b*, 5*c*, and 5*d* serve as primary transfer members. The power supplies 6 serves as a power supply unit and function as both primary-transfer electric-field forming unit and primary-transfer voltage detection unit.

The power supplies 6 apply the same current to the respective primary transfer rollers 5, that is, the power supplies 6 perform constant-current control. Then, each power supply 6 forms a primary-transfer electric-field between the four primary transfer rollers 5*a*, 5*b*, 5*c*, and 5*d* and the photoreceptors 1*a*, 1*b*, 1*c*, and 1*d*, and transfers a toner image formed on the photoreceptor 1 onto the intermediate transfer belt 21.

Beneath the primary-transfer image forming units 10, a secondary transfer unit 20 is provided. The secondary transfer unit 20 transfers the toner image formed on the intermediate transfer belt 21 onto a sheet as a recording medium. In the secondary transfer unit 20, the intermediate transfer belt 21 is wound around multiple rollers 22, 23, and 24, one of which is a driving roller, and rotates clockwise in FIG. 1 as appropriate timing.

In this embodiment, as for the intermediate transfer belt 21, a carbon-dispersed poly-imido resin belt whose thickness is 60 μm is used, and a surface resistivity thereof is preferably adjusted to $10^9$ Ωcm. The resistivity can be measured with a high resistivity meter, Hiresta UPMCP-HT450 (Mitsubishi Chemical, Ltd), after a voltage of 100 V is applied to the intermediate transfer belt 21. Moreover, in the present embodiment, tensile coefficient of elasticity of the intermediate transfer belt 21 is 2.6 GPa, for example.

In the secondary transfer unit 20, the secondary-transfer facing roller 23 is disposed facing a secondary transfer roller 25 via the intermediate transfer belt 21, with the secondary transfer roller 25 pressing against the secondary-transfer facing roller 23 via the intermediate transfer belt 21 in the secondary transfer unit 20. The sheet on the intermediate transfer belt 21 passes between the secondary transfer roller 25 and the secondary-transfer facing roller 23 (hereinafter together also referred to simply as secondary rollers). The secondary transfer roller 25 serves as a conductive member, and the secondary-transfer facing roller 23 serves as a secondary transfer member. A power supply 26 connected to the secondary-transfer facing roller 23 applies a predetermined secondary transfer current to the secondary-transfer facing roller 23, and forms a secondary-transfer electric-field (at a secondary transfer nip) between the secondary transfer roller 25 and the secondary-transfer facing roller 23. The power supply 26 serves as a secondary-transfer electric-field forming member.

In this printer 100, although the power supply 26 is connected the secondary-transfer facing member 23 and the secondary transfer current is applied to the secondary-transfer facing roller 23, alternatively, the power supply 26 can be connected to the secondary transfer roller 25 and the secondary transfer current can be applied to the secondary transfer roller 25.

In this embodiment, the volume resistivity of the roller portion (excluding a center metal) of the secondary-transfer facing roller 23 and the secondary transfer facing roller 25 is set to $10^9$ Ωcm.

The secondary transfer unit 20 further includes a temperature-humidity sensor 27 that measures the temperature and the humidity in the secondary transfer unit 20.

A conveyance unit 30 defining conveyance paths 31 and 38 through which the sheet is fed from a feed tray (not shown) is provided beneath the secondary transfer unit 20. Adjacent to the conveyance path 31, a pair of conveyance rollers 32 that conveys the sheet from the feed tray and a pair of registration roller 33 (made of stainless steel in the present embodiment) that correct the skew of the sheet and send out the sheet as appropriate are provided.

Additionally, a conveyance belt 34 that conveys the sheet onto which the toner image is transferred and a fixing device 35 that fixes the transferred toner image on the sheet are provided along the conveyance path 31. In the fixing device 35, a fixing roller 36 the temperature of which is set to 165° C. presses against a pressure roller 37 to fix the toner image on the sheet with heat and pressure. Further, a sheet reverse mechanism 39 that reverses the sheet to record images on both sides of the sheet in duplex printing is also provided on the conveyance path 38. The velocity of image formation is set to 280 mm/s in the present embodiment.

Next, image formation in the above-described printer 100 is described below. It is to be noted that each of the primary-transfer image forming unit 10*a*, 10*b*, 10*c*, and 10*d* has a similar configuration, differing only in the color of the toner used therein as an image forming material. Using the primary-transfer image forming unit 10*a* as an example, the process performed by the primary-transfer image forming unit 10*a*, 10*c*, and 10*d* is described in further detail below.

When a multicolor image is scanned by a scanner (not shown), in the conveyance unit 30, initially, the sheet is fed from the feed tray (not shown) and is conveyed by the pair of conveyance rollers 32. These conveyance rollers 32 grasp a leading edge of the sheet and convey it to the pair of registration rollers 33.

Along with these processes, in the primary-transfer image forming unit 10*a*, the noncontact roller 2*a* negatively biased by a power supply 3*a* uniformly charges the surface of the photoreceptor drum 1*a*, thus forming an electrostatic latent image on the surface of the photoreceptor drum 1*a*.

Then, the development device 4*a* supplies negatively-charged toner (in the present embodiment, polyester-type pulverized toner) to the latent image, and as a result, a single-color toner image that is a mirror image of the original image is formed on the photoreceptor drum 1*a*. At this time, the power supply 6*a* applies a specified primary transfer current whose polarity is the opposite of that of the toner to the primary transfer roller 5*a*. Consequently, the toner image is transferred from the photoreceptor drums 1*a* onto the intermediate transfer belt 21 by an electrostatic force generated between the photoreceptor drum 1*a* and the primary transfer roller 5*a*.

After transfer, any residual toner adhering to the outer circumference of the respective photoreceptor drum 1*a* is removed by a photoreceptor cleaning member, not shown, as preparation for a subsequent latent-image formation.

Similarly to the primary-transfer image forming unit 10*a*, in the primary-transfer image forming units 10*b*, 10*c*, and 10*d*, single-color toner images are formed as appropriate timing, and four single-color toner images are superimposed one on another on the intermediate transfer belt 21, forming a multicolor image (hereinafter "primary transfer image") on the intermediate transfer belt 21.

Subsequently, the sheet is conveyed to the secondary transfer roller 25 and the secondary-transfer facing roller 23 via the pair of registration rollers 33, timed to coincide with the arrival of the detected portion of the primary transfer image formed on the intermediate transfer belt 21 at the secondary transfer roller 25 and the secondary-transfer facing roller 23.

The time period (t) required for the primary transfer image to arrive at the secondary rollers is calculated by, for example, equation 1 below.

$$\tau = L_{1t2t}/V_{tVglt} \quad (1)$$

wherein L1t2t represents distance (m) on the intermediate transfer belt 21 between the primary rollers and the secondary rollers, and VtVglt represents velocity of the transfer-belt (m/s).

Subsequently, the sheet onto which the multicolor image is transferred at once at the secondary rollers is conveyed to the fixing device 35 by the conveyance belt 34 and is fixed on the sheet by the fixing device 35.

Subsequently, when the image is formed on only one side of the sheet and then discharged from the printer 100, the sheet on which the toner image is fixed is conveyed along the conveyance path 31, after which the sheet is discharged to a discharge tray, not shown.

By contrast, when images are to be formed on both sides of the sheet in duplex printing, the sheet on which the toner image is fixed is conveyed along the conveyance path 38 to the secondary rollers again by the sheet reversal mechanism 39. Then, another image is formed and fixed on the back side of the sheet, after which the sheet is discharged to the discharge tray.

Meanwhile, after the transfer process, residual toner adhering to the outer circumference of the intermediate transfer belt 21 is removed by a belt cleaning member 12, as preparation for subsequent image formation by the primary-transfer image formation unit 10*a*, 10*b*, 10*c*, and 10*d*.

Next, features of the present embodiment are described below.

The power supply 6 detects changes in a primary transfer voltage in a sub-scanning direction. The above-described printer 100 further includes a control device 28 that is operatively connected to the power supply 26 and which varies a secondary transfer current applied to the secondary-transfer facing roller 23 in accordance with changes in the primary transfer voltage in the sub-scanning direction detected by the power supply 6, timed to coincidence with the arrival of the detected portion of the primary transfer image at the secondary rollers.

Figure 2:
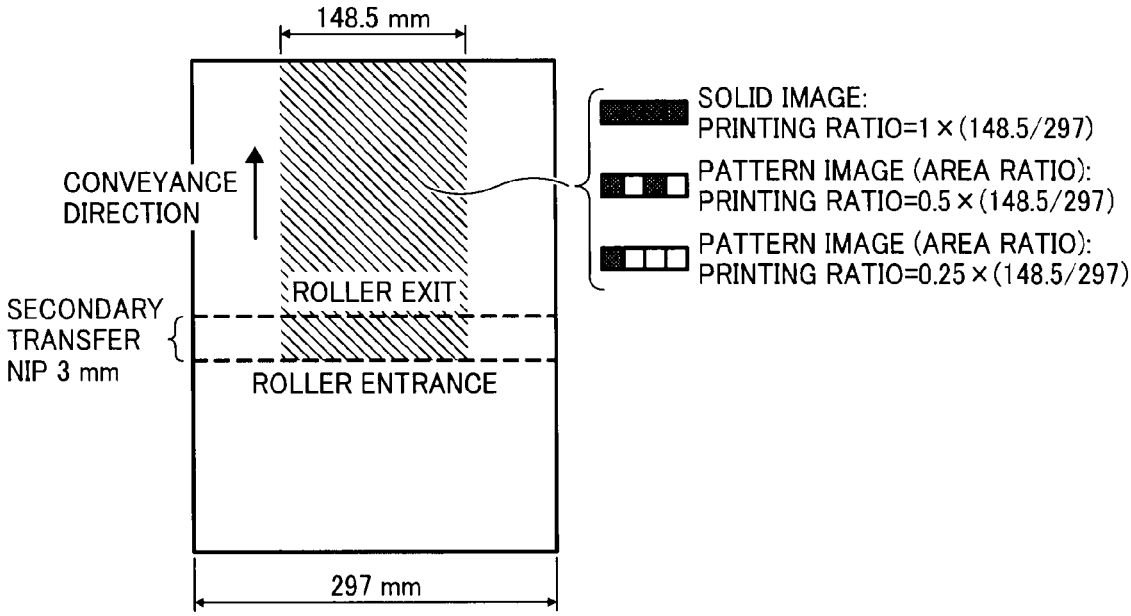
FIG. 2 is a diagram illustrating a definition of a printing ratio, for example, when an A3 sheet is passed through secondary rollers.

FIG. 2 is a diagram illustrating a definition of a printing ratio, for example, when an A3 sheet is passed through the secondary rollers. As described above, the term simply "printing ratio" means a ratio of the image area to the width of the sheet. The term "printing ratio (s)" means a ratio of the image area to the width of the sheet at an exit of the secondary rollers that is used as a standard portion for control).

Figure 3:
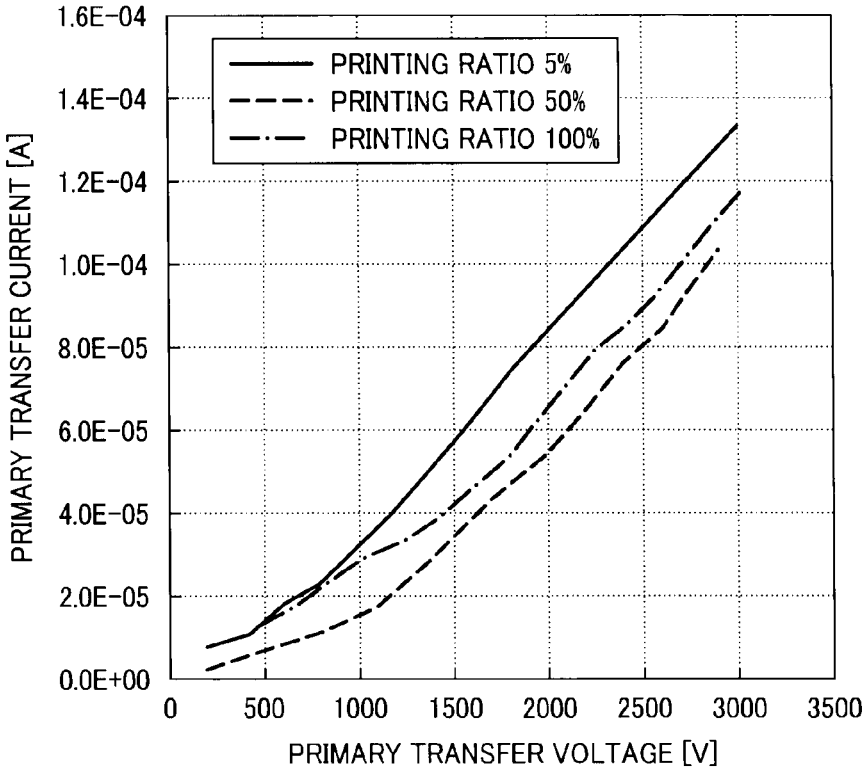
FIG. 3 is a graph of a voltage-current curve illustrating a relation between a primary transfer current and a primary transfer voltage when the printing ratio of a toner image in a main scanning direction is changed.

FIG. 3 is a graph of a voltage-current curve illustrating a relation between the primary transfer current and the primary transfer voltage. As shown in FIG. 3, when the same primary transfer current is applied, because the current flowing to the non-image area is greater than the current used for movement of the toner, the primary transfer voltage increases as the printing ratio increases. The control device 28 uses the data shown in FIG. 3 to calculate in advance a printing ratio (ηi') on the photoreceptors 1 in the main scanning direction based on the primary transfer voltage value corresponding to the applied primary transfer current.

Figure 4A:
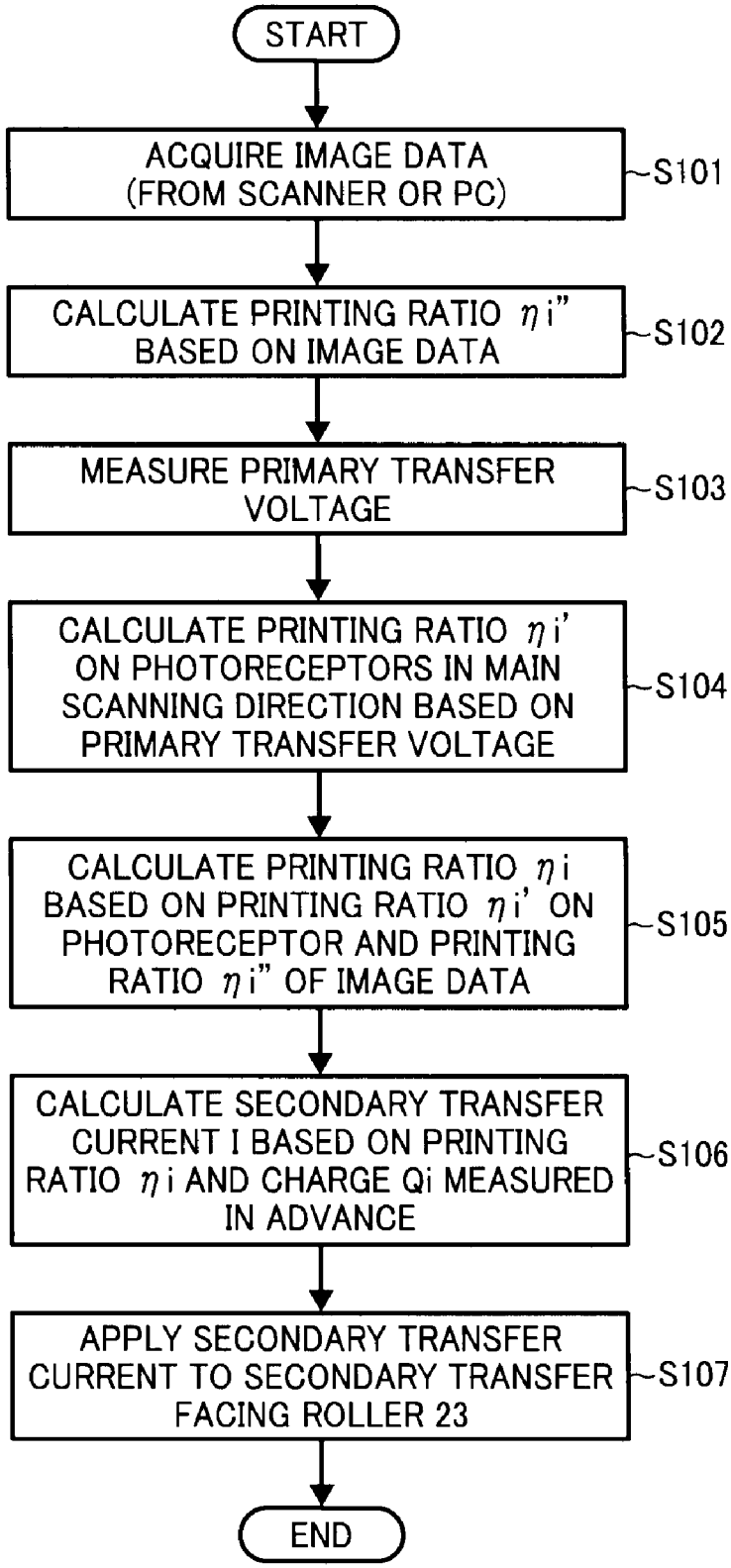
FIG. 4A is a flowchart illustrating steps in a control operation of a secondary transfer current using a printing ratio ($\eta i$) according to one illustrative embodiment of the present invention.

FIG. 4A is a flowchart illustrating steps in a control operation of the secondary transfer current using a printing ratio (ηi) according to the present embodiment.

Initially, at step S101, when the image forming is start, an image data from a scanner (not shown) or a personal computer (PC), not shown is acquired. Then, a printing ratio (ηi") is calculated based on the image data at step 102.

Further, in the primary transfer process, the power supplies 6*a*, 6*b*, 6*c*, and 6*d* detect respective primary transfer voltages that change in sub-scanning direction at step 103. The control device 28 calculates the printing ratio (ηi') on the photoreceptors 1 based on the primary transfer voltage, using data shown in FIG. 3 obtained according to a relation between the primary transfer current and the primary transfer voltage, at step 104.

Subsequently, at step S105, the control device 28 calculates the printing ratio (ηi) of the toner image in the main scanning direction that is a weighted mean value between the printing ratio (ηi') on the photoreceptors 1 and the printing ratio (ηi") of the image data, with reference to equation 2.

$$\eta I = \alpha \times \eta i' + (1-\alpha) \times \eta i'' \quad (2)$$

wherein "α" represents a constant between 0 to 1, and "ηi'" represents the printing ratio calculated based on the primary transfer voltage, and "ηi"" represents a printing ratio calculated based on the image data.

It is to be noted that a charge Qi of the respective color toner images at the exit of the secondary rollers is detected in advance.

Then, at step 106, the control device 28 calculates the secondary transfer current value I (−μA) for each pixel in the sub-scanning direction, using equation 3 shown below. That is, the control device 28 calculates the secondary transfer current value based on the printing ratio (ηi) of each toner image in the sub-scanning direction obtained at step 105, and an estimate of the charge Qi obtained.

$$I = A \times \Sigma(\eta i \times Qi) + B \quad (3)$$

wherein A and B represent coefficients, "ηi" represents the printing ratio of the respective color toner images, "Qi" represents charge (μC/g), and "i" represents the number of the primary-transfer image forming units 10 in the arrangement order in the direction in which the intermediate transfer belt 21 rotates. Namely, "Σ(ηi×Qi)" means that "(ηi×Qi)" in the respective primary-transfer image forming units 10 are combined.

Therefore, the secondary transfer current thus calculated is applied to the secondary transfer facing roller 23, at step 107.

Herein, printing ratios (ηi, ηi', and ηi") are obtained by using pixel number from the number of pixels per unit area. Generally, when the printing ratio is large, the number of pixels per unit area is large. Here, it is to be noted that the control device 28 can calculate the secondary transfer current value I (−μA) by using equation (3-1) shown below using the number of pixels per unit area, similarly to the control process using the printing ratio (ηi). More specifically, the control device 28 calculates the secondary transfer current based on the number of pixels (Ni/Nmax) in the main scanning direction and the charge Qi (μC/g).

Figure 4B:
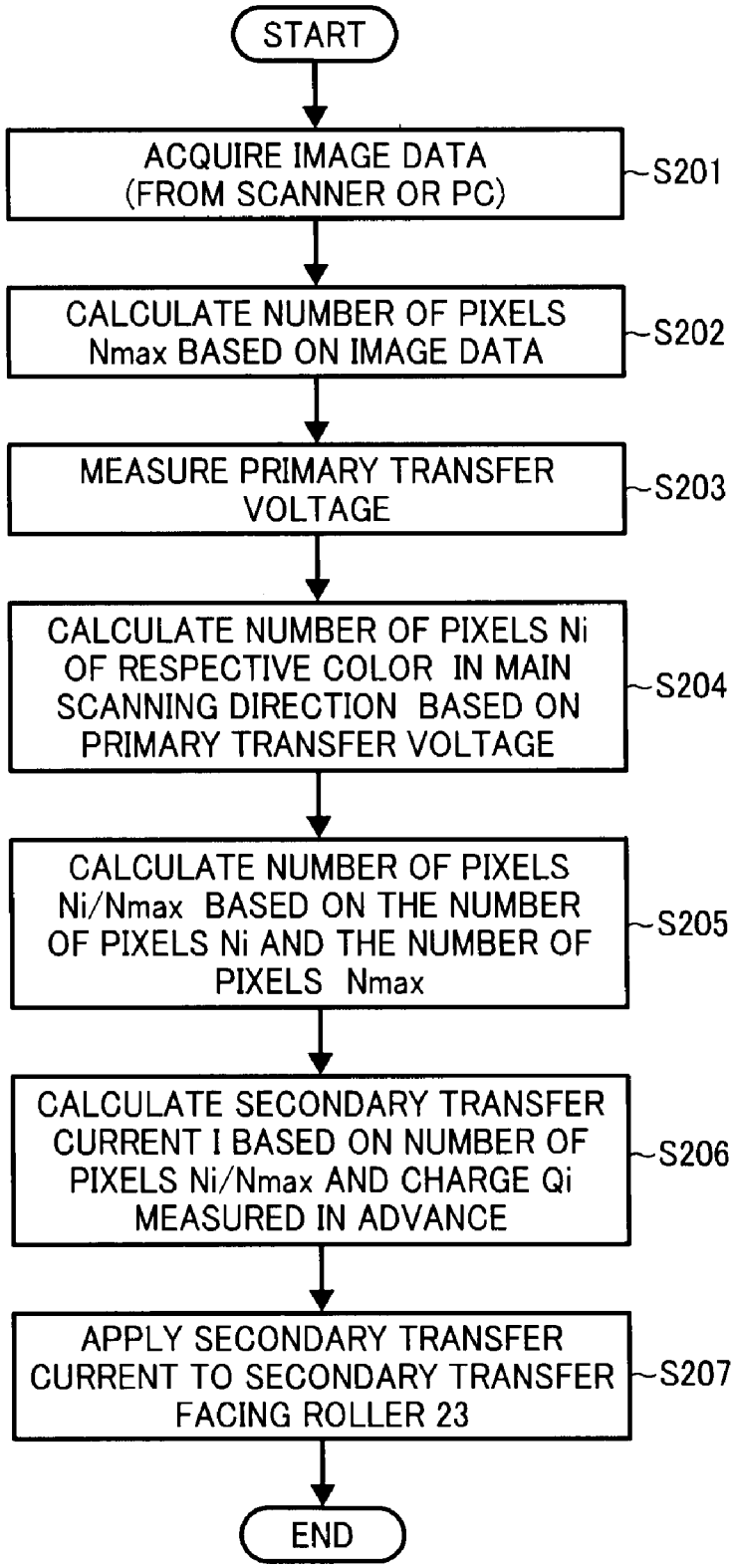
FIG. 4B is a flowchart illustrating steps in a control operation of the secondary transfer current using the number of pixels (Ni/Nmax) according to another illustrative embodiment of the present invention.

FIG. 4B is a flowchart illustrating steps in a control operation of the secondary transfer current using the number of pixels (Ni/Nmax) according to the present embodiment.

Similarly to the flowchart shown in FIG. 4A, after the image data is acquired at step 201, the number of pixels (Ni) of respective color in the main scanning direction is calculated at step 202. As for one instance, when the sheet width and the length per pixel in the main scanning direction are respectively is 297 mm and 42.33 μm, Nmax is calculated:

$$N\text{max}=297\text{ mm}/42.33\ \mu\text{m}=7016$$

Further, in the primary transfer process, the power supplies 6*a*, 6*b*, 6*c*, and 6*d* detect respective primary transfer voltages that change in sub-scanning direction, at step 203. The control device 28 calculates number of pixels Nmax obtained by dividing the sheet width in the main scanning direction by length per pixel in the main scanning direction, at step 204.

Subsequently, at step S205, the control device 28 calculates the number of pixels (Ni/Nmax) per unit area obtained by the number of pixels (Ni) of respective color divided by the number of pixels Nmax obtained from the image data. It is to be noted that a charge Qi of the respective color toner images at the exit of the secondary rollers is detected in advance.

Then, at step 206, the control device 28 calculates the secondary transfer current value I (−μA) by using equation (3-1) shown below using the number of pixels (Ni/Nmax) obtained at step 205 per unit area and the charge Qi (μC/g) obtained.

$$I=A\times\Sigma((Ni/N\text{max}))\times Qi)+B \qquad (3\text{-}1)$$

wherein Ni represents the number of pixels of respective color in the main scanning direction, Nmax represents the number of pixels obtained by dividing the sheet width in the main scanning direction by length per pixel in the main scanning direction. A and B represent coefficients. Herein, correlation is that "ηi=Ni/Nmax"

Consequently, the secondary transfer current thus calculated is applied to the secondary transfer facing roller 23, at step 207.

Therefore, similarly to using printing ratio(ηi), the control device 28 controls the power supply 26 so that the secondary transfer current value becomes high as the number of pixels (Ni/Nmax) in the main scanning direction increases.

In the present embodiment shown in FIG. 4A, the weighted mean between the printing ratio (ηi') calculated based on the primary transfer voltage shown in FIG. 3 and the printing ratio (ni") calculated based on the image data is used as the printing ratio (ηi) to set the secondary transfer current value I. However, taking into consideration detection tolerances of the detection member with respect to the primary transfer voltage, it is sufficient that the secondary transfer current value be calculated based on only the printing ratio (ηi') calculated only from the primary transfer voltage. In this case, the control device 28 does not need to calculate the printing ratio (ηi") from the image data (steps 101 and 102), and accordingly computation time can be reduced and the control device structure simplified, cutting costs.

Next, control of the secondary transfer current is described in detail below with reference to results of experiments.

Figure 5:
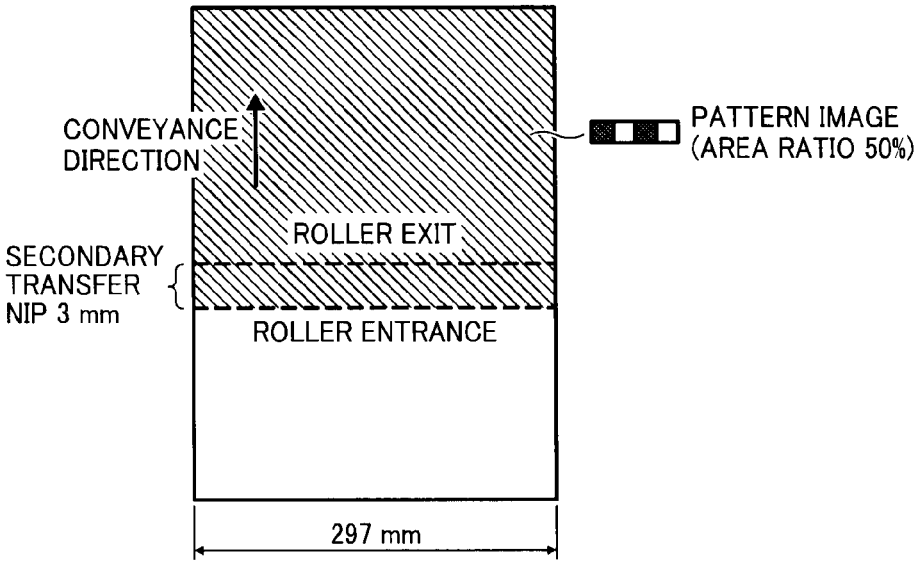
FIG. 5 illustrates an A3 a sheet having a printing ratio of 50%, passing through the secondary rollers, used in an experiment.
Figure 6:
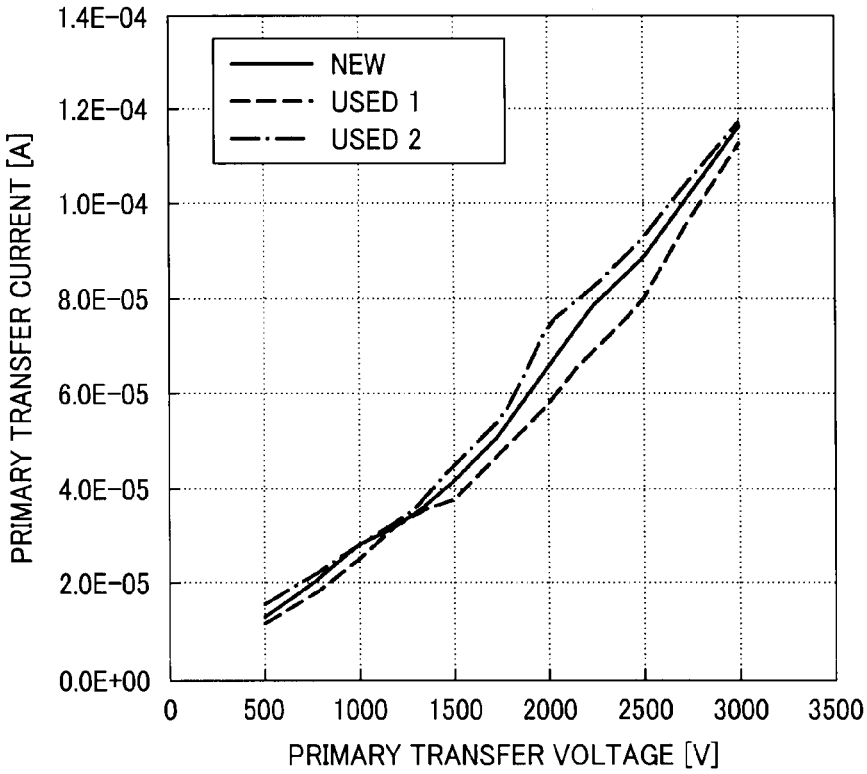
FIG. 6 is a graph illustrating the relation between the primary transfer current and the primary transfer voltage when the image forming apparatus shown in FIG. 1 was new and when developer and photoreceptor deteriorated after the image forming apparatus had printed 250,000 to 300,000 sheets (two points in time)

FIG. 5 illustrates an A3 a sheet having the printing ratio of 50%; passing through the secondary rollers, used in an experiment. FIG. 6 is a graph illustrating the relation between the primary transfer current and the primary transfer voltage at two points in time, that is, when the above-described printer 100 was new and when the developer and the photoreceptor 1 deteriorated after the printer 100 had printed 250,000 to 300,000 sheets.

As shown in FIG. 5, in the experiment, although the printing ratio was constant (50%) in the three cases, the relation between the primary transfer current and the primary transfer voltage changed depending on the condition of the printer 100.

More specifically, because the amount of the toner adhering to the photoreceptor 1 changes due to deterioration of the developer and the photoreceptor 1, the amount of the toner present in each dot increases or decreases. Namely, unlike the printing ratio (ηi") of the image data, the printing ratio (ηi') on the photoreceptor 1 (area ratio of the toner image) may be changed by the deterioration of the developer and/or the photoreceptor 1.

In order to accommodate this circumstance, the control device 28 calculates the printing ratio (ηi) in the main scanning direction based on the detected primary transfer voltage and then calculates the secondary transfer current in consideration of the printing ratio (ηi). Subsequently, the control device 28 applies the calculated secondary transfer current to the secondary-transfer facing roller 23, timed to coincide with the arrival (calculated by using equation 1) of the detected portion of the primary transfer image at the secondary rollers.

Figure 7:
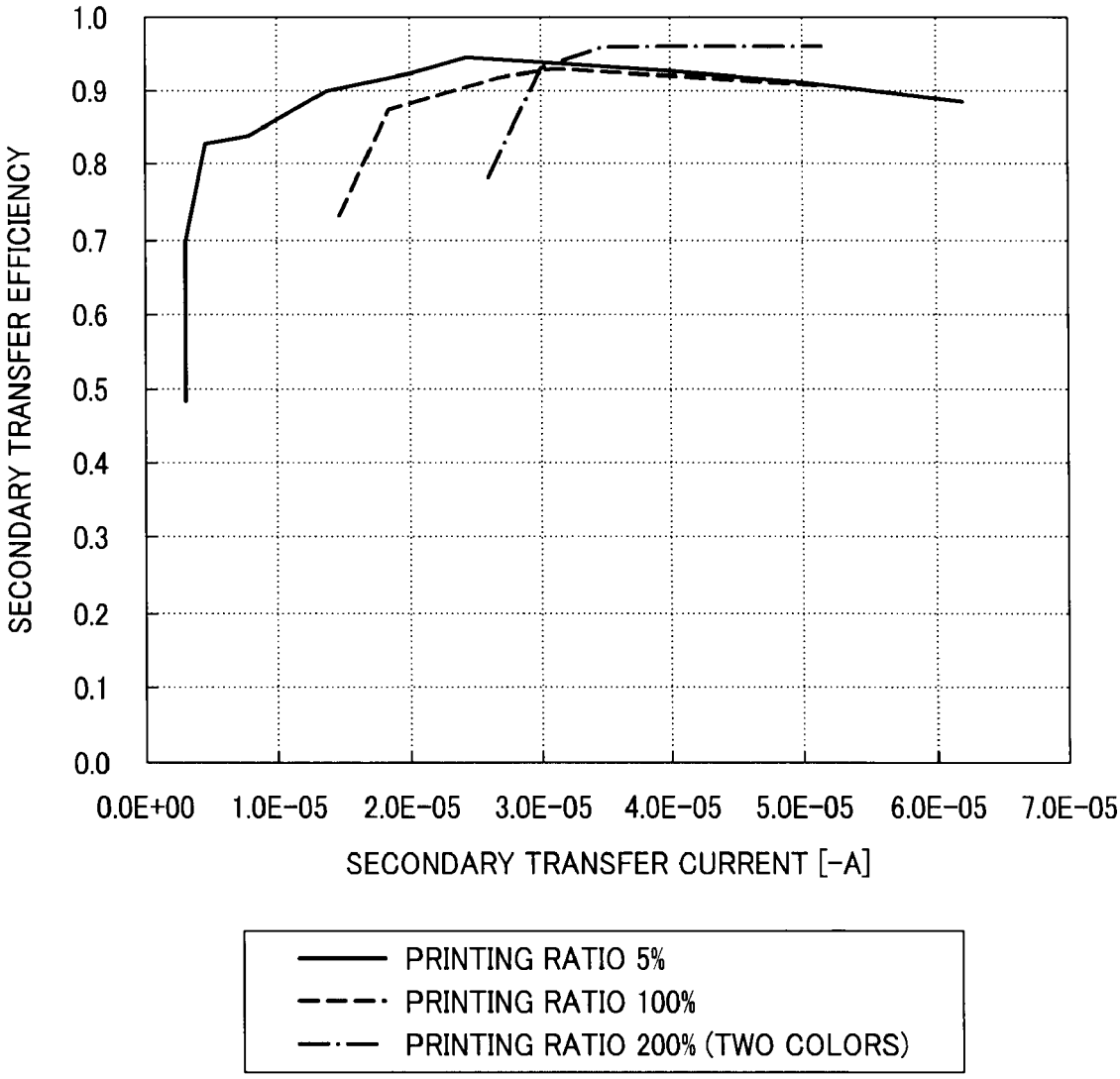
FIG. 7 is a graph illustrating how the printing ratio affects the relation between secondary transfer efficiency and secondary transfer current.

FIG. 7 is a graph illustrating how the printing ratio affects the relation between secondary transfer efficiency and the secondary transfer current obtained from another experiment, in which the secondary transfer efficiency was obtained by dividing the mass of the toner secondarily transferred onto the sheet by the mass of the toner primarily transferred onto the intermediate transfer belt 21.

As shown in FIG. 7, the current at which the secondary transfer efficiency is highest increases as the printing ratio increases. Therefore, the control device 28 controls the power supply 26 so that the secondary transfer current value increases as the printing ratio (ηi) in the main scanning direction increases.

It is to be noted that, in the experiment the results of which are shown in FIG. 6, a sheet of normal paper (NBS Ricoh, My Paper) that has passed through the fixing device 35 once (that is, the experiment was performed on a back side of the sheet in duplex printing) and a black toner (charge is 20 μC/g) were used.

Table 1 shows evaluation results of image density unevenness in a convex portion of a rough sheet having large asperity (wavy Japanese paper, Sazanami, manufactured by Ricoh) and absence rate (white void) of toner in a concave portion of the wavy sheet. In this experiment, using the above-described printer 100, when the single-color image whose printing ratio was 5% and the two-color image in which printing ratio of each color was 100% were secondarily transferred onto the back side of the rough sheet (having passed though the fixing device once), the secondary transfer current value was changed.

TABLE 1

| Secondary transfer current (−μA) | Printing ratio 5% | | |
|---|---|---|---|
| | Image density in concave portion | White void in convex portion | Overall evaluation |
| 5 | POOR | SATISFACTORY | POOR |
| 10 | SATISFACTORY | GOOD | SATISFACTORY |
| 15 | GOOD | GOOD | GOOD |
| 20 | GOOD | SATISFACTORY | GOOD |
| 25 | GOOD | POOR | GOOD |
| 30 | GOOD | POOR | GOOD |
| 35 | GOOD | POOR | GOOD |

| Secondary transfer current (−μA) | Double-color image (printing ratio of each color: 100%) | | |
|---|---|---|---|
| | Concave portion image density | Convex portion white void | Total evidence |
| 5 | POOR | POOR | POOR |
| 10 | POOR | POOR | POOR |
| 15 | POOR | POOR | POOR |
| 20 | SATISFACTORY | SATISFACTORY | SATISFACTORY |
| 25 | GOOD | GOOD | GOOD |
| 30 | GOOD | GOOD OR SATISFACTORY | GOOD |
| 35 | GOOD | POOR | POOR |

As shown in FIG. 6 and TABLE 1, the optimal secondary transfer current value increases as the printing ratio increases.

Additionally, in the case of high-asperity sheets, when the secondary transfer current value is extremely high, white void in the concave portion becomes noticeable at any printing ratio, and therefore image quality is degraded. Because discharging occurs when the secondary transfer current is extremely high, the polarity of charge of the toner on the intermediate transfer belt 21 is reversed by the discharging, and the image is not transferred onto the reversed portion of the sheet.

Consequently, the control device 28 in the printer 100 sets the secondary transfer current at which the secondary transfer efficiency of 0.9 is attained for each printing ratio(($\eta i$, $\eta i'$, $\eta i''$) and for each charge Qi of the toner when the transfer sheet has a relatively rough surface, that is, large asperities.

More particularly, when the user prints images using computers or when users make copies of documents set on the printer 100, the user can select a particular sheet, for example, "NBS Ricoh FC Japanese paper" on the printer screen on the computer or on a control panel (not shown) of the printer 100. Alternatively, the printer 100 can be configured so that, even when the user does not know the type of the sheet, the user can select "rough sheet".

When high-asperity sheets are selected, the secondary transfer current value is set by using equations 4 and 5 shown below. Consequently, even when high-asperity sheets are used, discharging in the concave portion can be prevented. Therefore, white void can be less noticeable, and the preferable final image can be produced.

By contrast, when the normal sheet is selected, because the discharging does not occur in the concave portion, the secondary transfer current is set to a value higher than the value calculated using the equation 4 by putting high priority to transfer efficiency and using equation 6 shown below.

$$I=0.41\times\Sigma\eta i+Qi+13.0 \quad (4)$$

$$\eta I=0.5\times\eta i'+0.5\times\eta i'' \quad (5)$$

$$I=0.41\times\Sigma\eta i\times Qi+23.7 \quad (6)$$

In this printer 100, although the effect of attaining uniform images is particularly high when high-asperity sheets are used, even when normal sheets are used, the printer 100 has an advantage that the transfer efficiency is superior by several percents to that attained when the second voltage is kept constant.

In the printer, with reference to equations 4 and 6, the control device 28 can calculate a more optimal secondary transfer current by referencing the charge of each single-color the toner image on the intermediate transfer belt 21, and therefore, preferable transfer can be achieved.

However, when difference among the charges Qi of the respective color toners is relatively small or the charge of the toner is stable against external factors, such as environmental conditions or stress, great effect can be accomplished even when the secondary transfer current is controlled based on only the printing ratio ($\eta i'$) based on the primary transfer voltage.

It is to be noted that the type of the function used by the control device 28 is not limited to the equations 2, 4, or 6, and the control device 28 can also have more simple function or more complicate function by considering another physical quantity, such as, humidity, temperature, or the amount of toner adhering to the intermediate transfer belt 21. In particular, because the charge Qi of the toner can change significantly depending on humidity, correcting the charge Qi, intercept, or gradient in equations 3 and 3-1 in accordance with the humidity is effective.

Moreover, the control device 28 may control the secondary transfer current value also based on a table preliminarily set in accordance with the charges Qi of respective toners or the printing ratio ($\eta i'$) based on the primary transfer voltage, instead of using the above-described functions (equations 1 through 6).

In this printer 100, although the printing ratio(s) at the exit portion of the secondary rollers is used as standard for control, alternatively, the printing ratio(s) in a center portion of the secondary rollers or an average amount of the printing ratio(s) in multiple portions of the secondary rollers can be also used.

Additionally, it may be unnecessary to control the secondary transfer current value for each pixel in the sub-scanning direction, and the secondary transfer current value may be controlled more roughly for example, by the width of the secondary rollers per process velocity, at each second, or for each image).

In this printer 100, as for the intermediate transfer belt 21, a belt material whose tensile coefficient of elasticity is equal or greater than 2.0 GPa and whose elasticity is higher than that of rubber (almost within a range from 1.0 MPa to 10 MPa) is used. In order to reduce color deviation and positional deviation, it is preferable that the intermediate transfer belt 21 is formed of a material whose elasticity has at least 2.0 GPa.

Although its degree of adhesion to high-asperity sheets is small when the intermediate transfer belt has a higher elasticity, in the present configuration, discharging in the concave portion can be prevented by maintaining a lower secondary transfer current value in accordance with the printing ratio (ηi') based on the primary transfer voltage and charge Qi of the toner. Therefore, occurrence of white void can be prevented.

Namely, uniformly transfer can be achieved when the sheet having a larger asperity is used, and in this printer, color deviation and position deviation caused by the primary transfer units can be prevented, and high durability of the intermediate transfer belt can be achieved in this printer.

As described above, in the present embodiment, the control device 28 determines the value of the secondary transfer current by calculating the printing ratio (ηi') (area ratio of the toner image on the photoreceptor drum 1) from the primary transfer voltage detected by the power supplies 6*a*, 6*b*, 6*c*, and 6*d*.

In this configuration, even when the printing ratio (ηi") calculated from the image data is different from the printing ratio (ηi') due to fluctuations in the toner amount or the charge, preferable secondary transfer can be achieved. Additionally, because the power supplies 6 detect the primary transfer voltage for each pixel in the sub-scanning direction, preferable secondary transfer can be performed regardless of changes in the printing ratio (ηi') in the sub-scanning direction.

Additionally, as described above, in the present embodiment, the optimal secondary transfer current value conducive to highly-efficient transfer in the secondary transfer process increases as the printing ratio increases. Additionally, when the primary transfer current is kept constant the primary transfer voltage increases as the printing ratio increases. Therefore, as the primary transfer voltage detected by the power supplies 6 increases, the control device 28 increases the secondary transfer current applied to the secondary-transfer facing roller 23, timed to coincidence with the arrival of the detected portion of the primary transfer image at the secondary rollers.

As a result, favorable secondary transfer can be performed, regardless of changes in the printing ratio.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image carrier on which a toner image is formed;

an intermediate transfer member onto which the toner image formed on the image carrier is transferred;

a primary transfer member disposed facing the image carrier via the intermediate transfer member, to transfer the toner image formed on the image carrier onto the intermediate transfer member;

a power supply unit, operatively connected to the primary transfer member, to form a primary-transfer electric-field between the image carrier and the primary transfer member by applying a primary transfer current to the primary transfer member by performing constant-current control; and to detect a change in a primary transfer voltage in a sub-scanning direction that is applied to the primary transfer member from the power supply unit in the sub-scanning direction;

a conductive member to sandwich a recording medium with the intermediate transfer member;

a secondary transfer member, disposed facing the conductive member via the intermediate transfer member, to transfer the toner image formed on the intermediate transfer member onto the recording medium;

a secondary-transfer electric-field forming member to form a secondary-transfer electric-field between the conductive member and the secondary transfer member and apply a secondary transfer current to the secondary transfer member or the conductive member; and a control device, operatively connected to the secondary-transfer electric-field forming member, to control the secondary transfer current applied to the secondary transfer member or the conductive member in accordance with the change in the primary transfer voltage in the sub-scanning direction detected by the power supply unit.

2. The image forming apparatus according to claim 1, wherein, timed to coincidence with arrival of a detected portion of a primary transfer image at a portion between the secondary transfer member and the conductive member, the control device increases the secondary transfer current applied to the secondary transfer member or the conductive member by the secondary-transfer electric-field forming member as the primary transfer voltage detected by the power supply unit increases.

3. The image forming apparatus according to claim 2, wherein the control device references a printing ratio obtained from the primary transfer voltage and increases the secondary transfer current applied to the secondary transfer member or the conductive member by the secondary-transfer electric-field forming member as the printing ratio increases.

4. The image forming apparatus according to claim 3, wherein the control device references a printing ratio obtained from image data on the recording medium, calculates the secondary transfer current based on the printing ratio obtained from the primary transfer voltage and the printing ratio obtained from the image data, and increases the calculated secondary transfer current applied to the secondary transfer member or the conductive member by the secondary-transfer electric-field forming member as the printing ratios increase.

5. The image forming apparatus according to claim 2, wherein the control device references a number of pixels obtained from the primary transfer voltage and increases the secondary transfer current applied to the secondary transfer member or the conductive member by the secondary-transfer electric-field forming member as the number of pixels increases.

6. The image forming apparatus according to claim 5, wherein the control device references a number of pixels obtained from image data on the recording medium, calculates the secondary transfer value based on the number of pixels obtained from the primary transfer voltage and the number of pixels obtained from the image data, and increases the secondary transfer current applied to the secondary transfer member or the conductive member by the secondary-transfer electric-field forming member as the numbers of pixels increase.

7. The image forming apparatus according to claim 2, wherein the control device references an absolute value of a charge of the toner image on the intermediate transfer member and increases the secondary transfer current applied to the secondary transfer member or the conductive member by the secondary-transfer electric-field forming member as the absolute value of the charge increases.

8. The image forming apparatus according to claim 1, wherein the intermediate transfer member comprises a belt material whose tensile coefficient of elasticity is equal to or greater than 2.0 GPa.

9. A control method for an image forming apparatus including an image carrier, an intermediate transfer member, a power supply unit, a primary transfer member, a secondary transfer member, a conductive member disposed facing the secondary transfer member via the intermediate transfer member, the control method comprising:

forming a primary-transfer electric-field between the image carrier and the primary transfer member;

applying a constant primary transfer current to the primary transfer member;

forming a secondary-transfer electric-field between the conductive member and the secondary transfer member;

applying a secondary transfer current to the secondary transfer member or the conductive member;

detecting a change in a primary transfer voltage that is applied to primary transfer member in a sub-scanning direction; and controlling the secondary transfer current applied to the secondary transfer member or the conductive member in accordance with the change in the primary transfer voltage that is applied to primary transfer member in the sub-scanning direction.

10. The control method according to claim 9, further comprising:

increasing the secondary transfer current as the primary transfer voltage detected by the power supply unit increases; and applying the secondary transfer current to the secondary transfer member or the conductive member in accordance with the change in the primary transfer voltage, timed to coincidence with arrival of a detected portion of a primary transfer image at a portion between the secondary transfer member and the conductive member.

11. The control method according to claim 10, further comprising:

referencing a printing ratio obtained from the primary transfer voltage;

increasing the secondary transfer current as the printing ratio increases; and applying the secondary transfer current based on the printing ratio to the secondary transfer member or the conductive member.

12. The control method according to claim 10, further comprising:

referencing a printing ratio obtained from image data on the recording medium;

calculating the secondary transfer current based on the printing ratio obtained from the primary transfer voltage and the printing ratio obtained from the image data;

increasing the secondary transfer current as the printing ratios increase; and applying the secondary transfer current to the secondary transfer member or the conductive member.

13. The control method according to claim 10, further comprising:

referencing a number of pixels obtained from the primary transfer voltage;

increasing the secondary transfer current as the number of pixels increases; and applying the secondary transfer current based on the number of pixels to the secondary transfer member or the conductive member.

14. The control method according to claim 13, further comprising:

referencing a number of pixels obtained from image data on the recording medium;

calculating the secondary transfer current based on the number of pixel obtained from the primary transfer voltage and the number of pixels obtained from the image data;

increasing the calculated secondary transfer current as the numbers of pixels increase; and applying the secondary transfer current based on the number of pixels of the primary transfer voltage to the secondary transfer member or the conductive member.

15. The control method according to claim 10, further comprising:

referencing an absolute value of a charge of the toner image on the intermediate transfer member;

increasing the secondary transfer current as the absolute value of the charge increases; and applying the secondary transfer current based on the absolute value of the charge to the secondary transfer member or the conductive member.

* * * * *